US006769756B2

(12) United States Patent
Su et al.

(10) Patent No.: US 6,769,756 B2
(45) Date of Patent: Aug. 3, 2004

(54) INK DROP DETECTOR CONFIGURATIONS

(75) Inventors: Wen-Li Su, Vancouver, WA (US); Sam Sarmast, Vancouver, WA (US); Patrick J. Therien, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2 days.

(21) Appl. No.: 09/916,008

(22) Filed: Jul. 25, 2001

(65) Prior Publication Data

US 2003/0160838 A1 Aug. 28, 2003

(51) Int. Cl.[7] ..... B41J 2/01
(52) U.S. Cl. ..... 347/19; 347/81
(58) Field of Search ..... 347/19, 81, 29, 347/31, 35, 36

(56) References Cited

U.S. PATENT DOCUMENTS 3,886,564 A * 5/1975 Naylor, III et al ..... 347/81
3,977,010 A * 8/1976 Erickson et al. ..... 347/81
4,121,223 A * 10/1978 Omori et al. ..... 347/81
4,434,428 A * 2/1984 Horike et al. ..... 347/81
5,160,939 A * 11/1992 Bajeux et al. ..... 347/78
5,745,134 A * 4/1998 Hirabayashi et al. ..... 347/36
6,203,137 B1 * 3/2001 Niimura et al. ..... 347/36

* cited by examiner

*Primary Examiner*—Craig Hallacher

(57) ABSTRACT

A sensor configuration for use in detecting ink droplets ejected from an ink drop generator is provided. The sensor configuration includes a sensing element configured to receive a biasing voltage which creates an electric field from the sensing element to the ink drop generator. The sensor configuration also includes a sensing amplifier coupled to the sensing element, whereby the sensing element in imparted with an electrical stimulus when at least one ink droplet is ejected in the presence of the electric field, and thereafter passes in close proximity to the sensing element without substantially contacting the sensing element. Sensor configurations with a separate electrically biasing element which may or may not contact the ink droplets are also provided. Additionally, a printing mechanism having such sensor configurations and a method of making ink drop detection measurements are also provided.

33 Claims, 6 Drawing Sheets

INK DROP DETECTOR CONFIGURATIONS

INTRODUCTION

The present invention relates generally to printing mechanisms, such as inkjet printers or inkjet plotters. Printing mechanisms often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains linear arrays of heater elements, such as resistors, which are individually addressable and energized to heat ink within the vaporization chambers. Upon heating, an ink droplet is ejected from a nozzle associated with the energized resistor. The inkjet printhead nozzles are typically aligned in one or more linear arrays substantially parallel to the motion of the print media as the media travels through the printzone. The length of the linear nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism may achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle," in the print media that a single pass swath would cause.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that the drop size, relative position of the ink drops, and color of a small, discreet number of process inks are integrated by the naturally occurring visual response of the human eye to produce the effect of a large colors pace with millions of discernible colors and the effect of a nearly continuous tone. In fact, when these imaging techniques are performed properly by those skilled in the art, near-photographic quality images can be obtained on a variety of print media using only three to eight colors of ink. This high level of image quality depends on many factors, several of which include: consistent and small ink drop size, consistent ink drop trajectory from the printhead nozzle to the print media, and extremely reliable inkjet printhead nozzles which do not clog.

Unfortunately, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead scrapers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged or failed printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a low cost ink drop detection system, such as the one described in U.S. Pat. No. 6,086,190 assigned to the present assignee, Hewlett-Packard Company. The nozzle plate of a printhead is inherently near ground potential due to the power supply connections on the printhead. A conductive target may be placed a few millimeters below the nozzle plate, and a biasing voltage may be applied to the target, forming an electric field between the nozzle plate and the target. Upon firing an ink drop, as the ink drop begins to exit the nozzle, a charge accumulates on the protruding tip of the drop, due to the influence of the nozzle-plate-to-target electric field. When drop breakoff occurs, the drop retains this charge. When the drop contacts the target, a small current, in relation to the charge on the drop, is induced from the target to ground. The periodic flow of current from drops striking the target may be converted to a signal voltage by an amplifier which is AC-coupled to the target, and then an analog-to-digital converter may digitize the output signal for processing to determine if a nozzle or group of nozzles are working properly.

In practical implementation, however, this drop detection system has some limitations. Successive drops of ink, drying on top of one another quickly form stalagmites of dried ink which may grow toward the printhead. Since it is preferable to have the electrostatic sensing element very close to the printhead for more accurate readings, these stalagmites may eventually interfere with or permanently damage the printhead, adversely affecting print quality. Therefore, it is desirable to have a low cost and efficient method and mechanism for ink drop detection which is less susceptible to waste ink residue build-up.

DETAILED DESCRIPTION OF THE PREFERRED EMBODIMENTS

Figure 1:
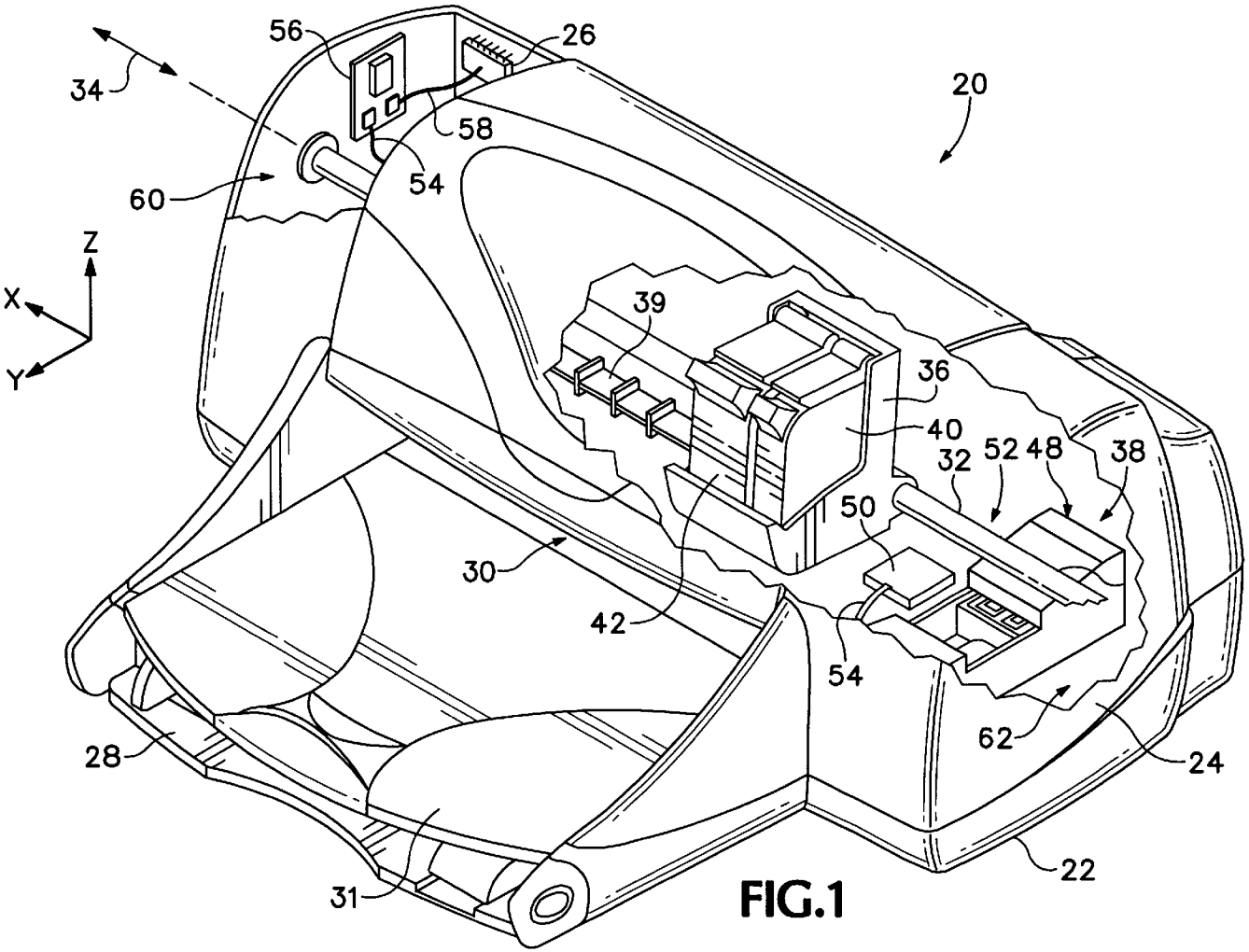
FIG. 1 is a fragmented perspective view of one form of an inkjet printing mechanism illustrated with one embodiment of an absorbent conductive drop detector.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instructions from a host device, such as a computer, print server, or personal data assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media (not shown) from the media input tray 28 through a printzone 30 and to an output tray 31. A carriage guide rod 32 is mounted to the chassis 22 to define a scanning axis 34, with the guide rod 32 slideably supporting an inkjet carriage 36 for travel back and forth, reciprocally, across the printzone 30. A conventional carriage drive motor (not shown) may be used to propel the carriage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader, may also be accomplished in a variety of ways known to those skilled in the art.

In the printzone 30, the media sheet is supported by paper path ribs 39 and receives ink from an inkjet cartridge, such as a black ink cartridge 40 and a color inkjet cartridge 42. The cartridges 40 and 42 are also often called "pens" by those in the art. The black ink pen 40 is illustrated herein as containing a pigment-based ink. For the purposes of illustration, color pen 42 is described as containing three separate dye-based inks which are colored cyan, magenta, and yellow, although it is apparent that the color pen 42 may also contain pigment-based inks in some implementations. It is apparent that other types of inks may also be used in the pens 40 and 42, such as paraffin-based inks, as well as hybrid or composite inks having both dye and pigment characteristics. The illustrated printer 20 uses replaceable printhead cartridges where each pen has a reservoir that carries the entire ink supply as the printhead reciprocates over the printzone 30. As used herein, the term "pen" or "cartridge" may also refer to an "off-axis" ink delivery system, having main stationary reservoirs (not shown) for each ink (black, cyan, magenta, yellow, or other colors depending on the number of inks in the system) located in an ink supply region. In an off-axis system, the pens may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as "snapper" cartridges which have ink reservoirs that snap onto permanent or semi-permanent print heads.

The illustrated black pen 40 has a printhead 44, and color pen 42 has a tri-color printhead 46 which ejects cyan, magenta, and yellow inks. The printheads 44,46 selectively eject ink to form an image on a sheet of media when in the printzone 30. The printheads 44, 46 each have an orifice plate with a plurality of nozzles formed therethrough in a manner well known to those skilled in the art. The nozzles of each printhead 44, 46 are typically formed in at least one, but typically a plurality of linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 34, with the length of each array determining the maximum image swath for a single pass of the printhead. The printheads 44, 46 are thermal inkjet printheads, although other types of printheads may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media when in the printzone 30 under the nozzle. The printhead resistors are selectively energized in response to firing command control signals delivered from the controller 26 to the printhead carriage 36. It is also possible to implement a page-wide printhead array which does not need to be reciprocated across the printzone 30.

Between print jobs, the inkjet carriage 36 moves along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

The printer chassis 22 is illustrated as supporting an electrically biased absorbent electrostatic sensing element, or "electrically biased absorbent target" 50, in the printer's "inboard" region 52 located on the side of service station 48 near the printzone 30. The print carriage 36 may be moved along carriage guide rod 32 until printheads 44, 46 are positioned over the electrically biased absorbent target 50. Ink droplets may be fired onto the upper surface of electrically biased absorbent target 50 and detected according to the method described in U.S. Pat. No. 6,086,190, assigned to the Hewlett-Packard Company, the present assignee. Target 50 may be constructed by using a foam pad which is pretreated with a conductive solvent such as glycerol or polyethylene glycol (PEG). Other absorbent materials may similarly be selected depending on design or cost restraints, for example, the electrically biased absorbent target 50 could be constructed of polyurethane or a rigid and porous sintered plastic. Electrically biased sensing conductor 54 applies a biasing voltage to the target 50 while also connecting the target 50 to an electrostatic drop detect printed circuit board assembly (PCA) 56. The PCA 56 contains various electronics (not shown) for filtering and amplification of drop detection signals received from the target 50 via electrically biased sensing conductor 54. An additional electrical conductor 58 links the PCA 56 to controller 26 for drop detection signal processing. PCA 56 may be located in various locations inside of the printer 20 to accommodate design goals such as sharing PCA real estate with other circuitry, locating in the proximity of the target 50 to reduce signal noise effects, or to remove the PCA 56 from the vicinity of conductive ink residue and ink aerosol.

Electrically biased absorbent target 50 does not need a cleaning mechanism, so it is simple to construct and economical, and should prevent the build-up of ink residue stalagmites as ink droplets are fired onto the target 50 because the droplets can be absorbed into the target 50 and preferably kept in solution by the optional ink solvent present in the target 50. Electrically biased absorbent target 50 may be constructed in varying sizes to accommodate a portion of a printhead's 44, 46 nozzles, an entire printhead's 44, 46 nozzles, or even all of the nozzles for multiple printheads 44, 46. Additionally, electrically biased absorbent target 50 may be located in other locations below the plane defined by printheads 44, 46 as they are propelled by the printhead carriage 36 back and forth on carriage guide rod 32 along scanning axis 34. Examples of alternate locations for electrically biased absorbent target 50 include, for example, the "outboard region" 60 which is on the opposite side of printzone 30 from the service station 48, the servicing region 38, and "outside service station region" 62.

Figure 2:
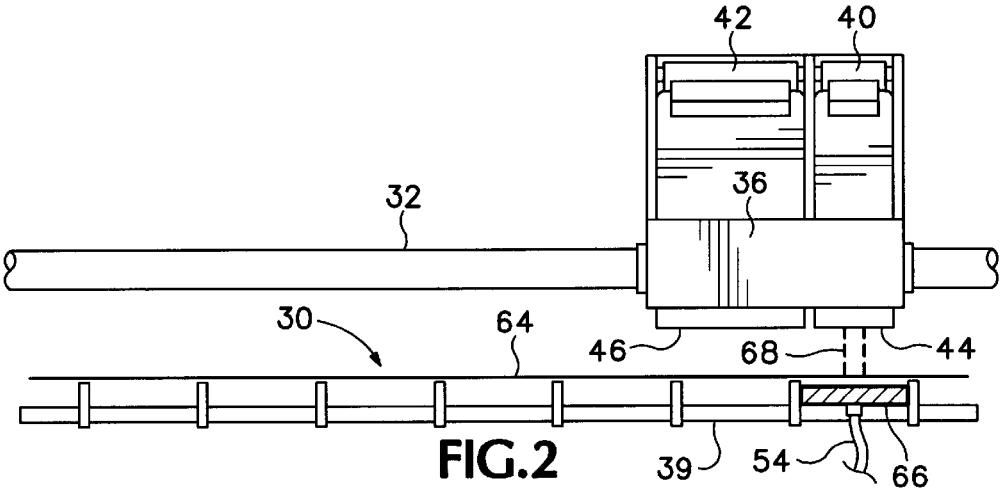
FIGS. 2–3 are an enlarged, side elevational views illustrating separate embodiments of a drop detector coupled with a paper path support.
Figure 3:
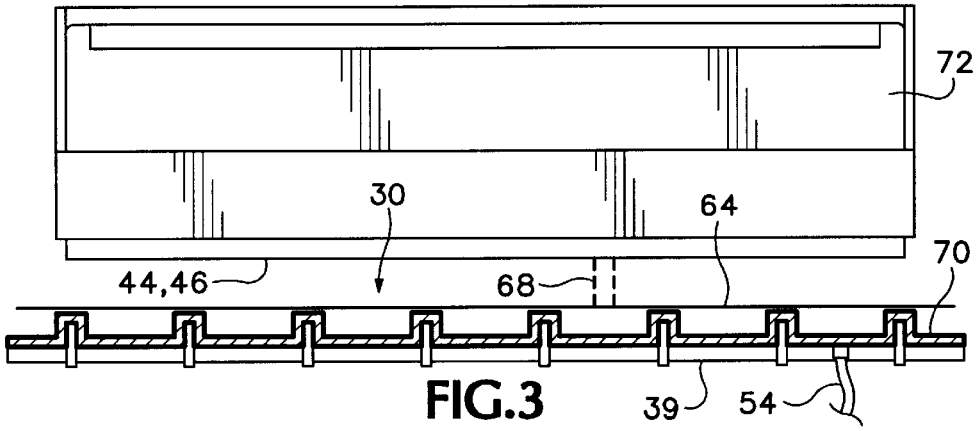
Figure 4:
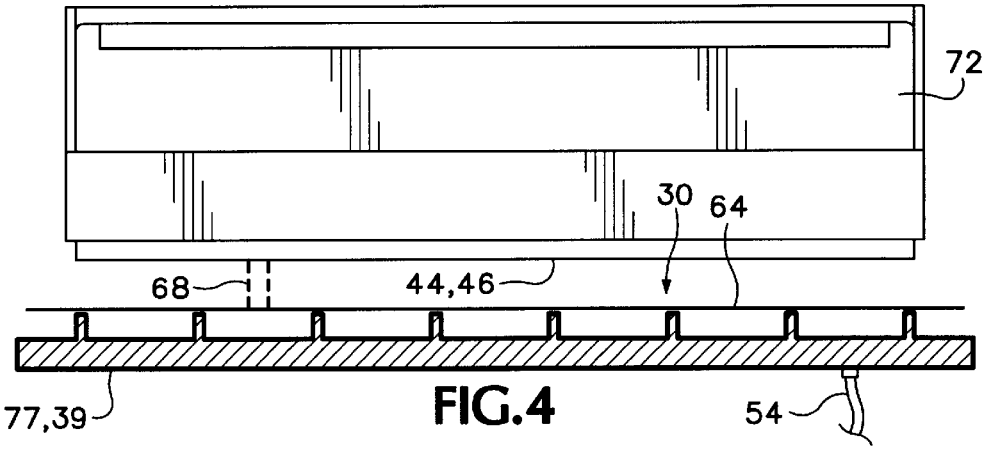
FIG. 4 is an enlarged, side elevational view of illustrating an embodiment of a drop detector integral with a paper path support.
Figure 5:
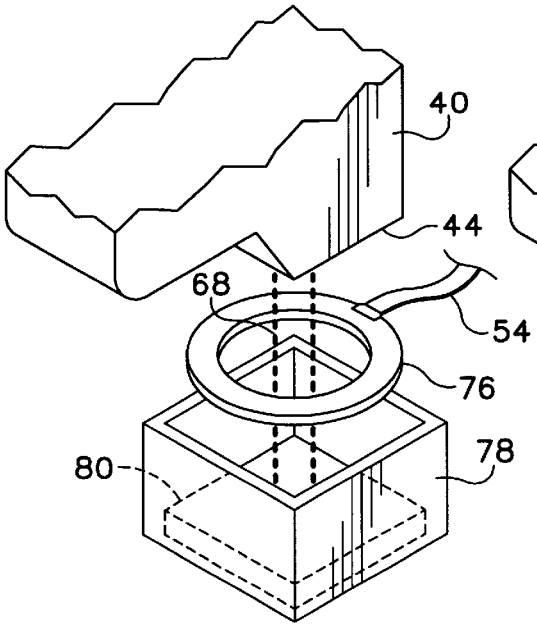
FIGS. 5–12 are enlarged, partially fragmented perspective views illustrating separate embodiments of non-contact drop detectors.
Figure 6:
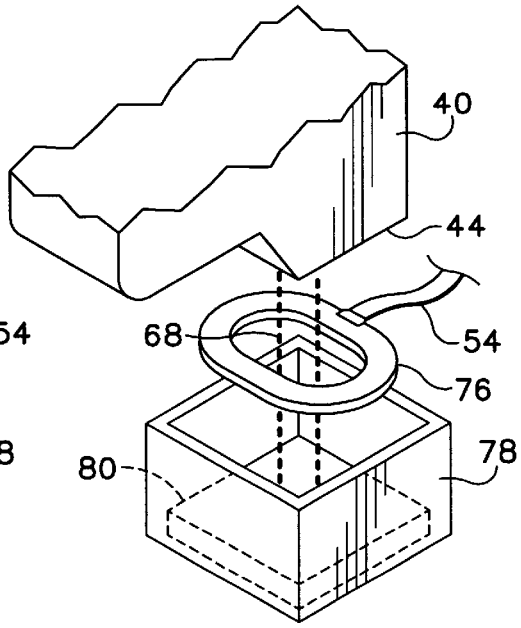
Figure 7:
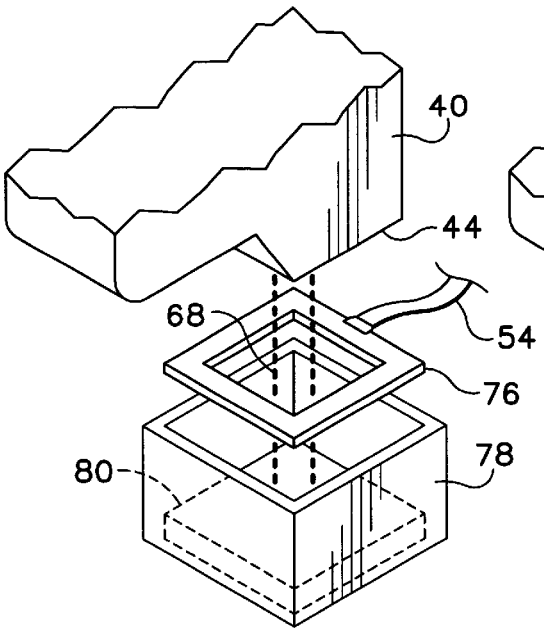
Figure 8:
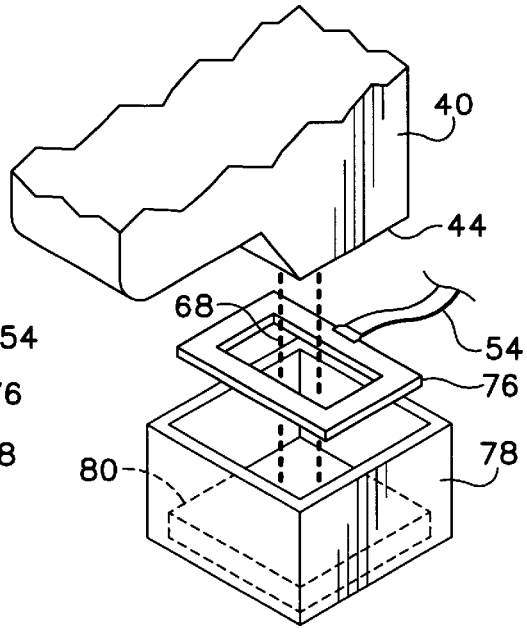
Figure 9:
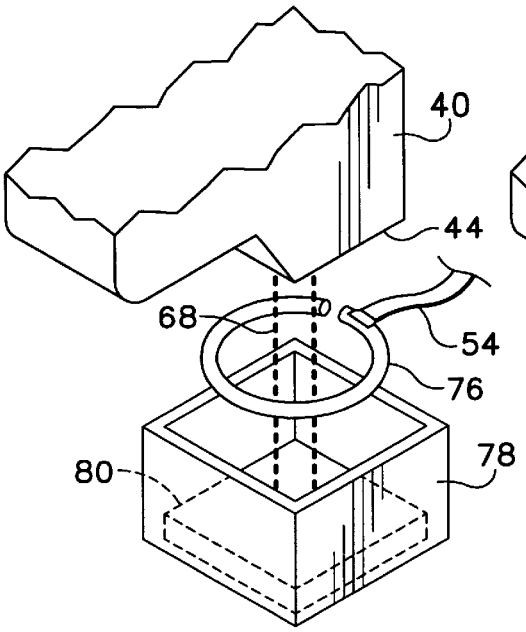
Figure 10:
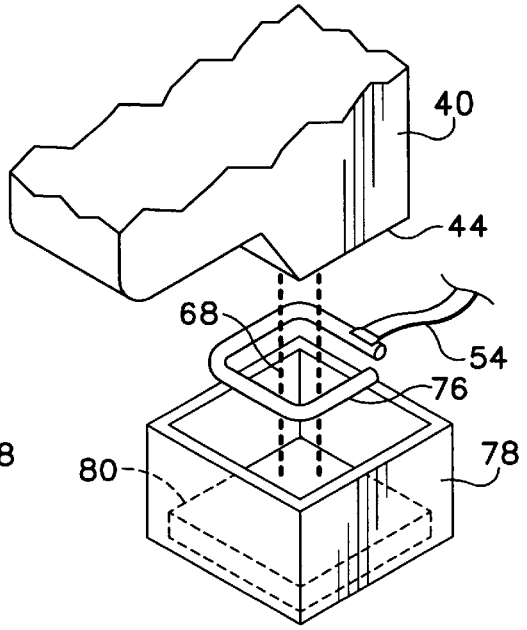

FIGS. 2–4 illustrate embodiments of a non-contact electrically biased sensing target for use with a drop detector system. The printzone paper path ribs 39 support a sheet of printable media 64 as it is moved through the print zone 30. For clarity of illustration, the printable media 64 is not shown in contact with the paper path ribs 39, however, is actual practice, the printable media 64 is in contact with and supported by the paper path ribs 39 in the printzone 30. As FIG. 2 illustrates, a non-contact electrically biased target 66 may be attached to the printzone paper path ribs 39 such that the target 66 rides below, yet does not interfere with, the printable media 64 as it passes over the paper path ribs 39 through the printzone. An electrically biased sensing conductor 54 may connect the non-contact electrically biased sensing target to the drop detector PCA 56 as illustrated in FIG. 1 for signal filtering and amplification. Electrically biased sensing conductor 54 also provides a biasing voltage to the target 66. The reciprocating printhead carriage 36 may be moved along carriage guide rod 32 until either of the printheads 44, 46 or a selected portion of each one is positioned over the non-contact electrically biased target 66. The biasing voltage present on the target 66 creates an electric field between the target 66 and the ground plane present at the nozzle plate of the printheads 44, 46. Selected printhead 44, 46 nozzles may then be fired in response to commands from controller 26 to eject ink droplets 68 onto the print media 64 over the non-contact electrically biased target 66. As each droplet 68 begins to exit the printhead 44, 46 nozzle, a charge accumulates on the protruding tip of the drop, due to the influence of the printhead 44, 46 nozzle-plate-to-target 66 electric field. When drop breakoff occurs, the drop retains this charge. When the drop contacts the print media 64, a small capacitive current, in relation to the charge on the ink droplet 68, is created from the target 66 to ground. The periodic flow of capacitive current, from ink droplets 68 striking the print media 64 over target 66, may be converted to a digitized signal voltage by PCA 56 which is coupled to the target 66 via electrically biased sensing conductor 54. Processor 26 may then receive the digital signal from PCA 56 via conductor 58 for processing to determine if a nozzle or group of nozzles are working properly.

FIG. 3 illustrates another embodiment of a non-contact electrically biased sensing target for use with a drop detector system. Similar to the target 66 in FIG. 2, the embodiment of FIG. 3 has a non-contact electrically biased target 70, however the target 70 of FIG. 3 may be coated or attached over the entire length of the paper path ribs 39 in the printzone 30. The printable media 64 passes over target 70, supported by target 70 and paper path ribs 39 as the print media 64 is moved through the print zone. Since the target 70 is full-width with respect to the printzone 30, drop detection measurements may be taken at any location ink droplets 68 are fired onto the print media 64, by examining the digital signal created by the capacitive current as done for the embodiment in FIG. 2. The embodiment illustrated in FIG. 3 may be used with reciprocating printheads 44, 46, or with a full-width printhead array 72.

FIG. 4 illustrates another embodiment of a non-contact electrically biased sensing target for use with a drop detector system. Similar to the target 70 in FIG. 3, the embodiment of FIG. 4 has a full-width non-contact electrically biased target 74, however the target 74 of FIG. 4 is integrally constructed with the paper path ribs 39 as opposed to the coated or attached target 70. A conductive material such as, for example, copper, gold, palladium, stainless steel, or conductive plastic may be used to form the target 74 as illustrated in FIG. 4. Since the target 74 also performs the functions of paper path ribs 39 in FIG. 2, the target 74 naturally rides below, and does not interfere with, the printable media 64 as it passes over the target 74 through the printzone. Since the target 74 is full-width with respect to the printzone 30, drop detection measurements may be taken at any location ink droplets 68 are fired onto the print media 64, by examining the digital signal created by the capacitive current as done for the embodiment in FIG. 2. The embodiment illustrated in FIG. 4 may be used with reciprocating printheads 44, 46, or with a full-width printhead array 72. Additionally, drop detection measurements taken using the sensors illustrated in FIGS. 2–4 may be taken while printing a calibration or test page, or even while printing any print job.

FIGS. 5–10 illustrate embodiments of a non-contact electrically biased sensing target for use with a drop detector system. In each of the embodiments illustrated in FIGS. 5–10, a pen, such as black pen 40, may be positioned such that the printhead 44 nozzles are aligned over the opening defined by the target loop 76. It is intended that target loop 76 not be limited to the sizes and shapes shown in FIGS. 5–10. Rather, the intent of illustrating various possible designs for the target loop 76 is to show that many shapes may be good candidates to select for a given application, such as, for example, circles, ovals, squares, rectangles, triangles, trapezoids, and other multi-sided or curved shapes, based on factors such as the size of the printheads, the electric field desired, and manufacturing concerns. The target loop 76 may be constructed by stamping it from a sheet of metal, forming it out of a conductive plastic, coating a plastic of the desired shape with a conductive material, bending a wire, or using a printed circuit board. Other methods of construction will be readily apparent to those skilled in the art, and are intended to be covered within the scope of this description.

An electrically biased sensing conductor 54 may connect the non-contact target loop 76 to the drop detector PCA 56 as illustrated in FIG. 1 for signal filtering and amplification. Electrically biased sensing conductor 54 provides a biasing voltage to the target loop 76. The biasing voltage present on the target loop 76 creates an electric field between the target loop 76 and the ground plane present at the nozzle plate of the printhead 44. Selected printhead 44 nozzles may then be fired in response to commands from controller 26 to eject ink droplets 68 through the opening defined by target loop 76. As each droplet 68 begins to exit the printhead 44 nozzle, a charge accumulates on the protruding tip of the drop, due to the influence of the printhead 44 nozzle-plate-to-target loop 76 electric field. When drop breakoff occurs, the droplet 68 retains this charge. When the droplet 68 approaches and passes through the opening defined by the target loop 76, a small current is induced from the target loop 76, in relation to the charge on the ink droplet 68, to ground. The periodic flow of this induced current from ink droplets 68 passing through the target loop 76 may be converted to a digitized signal voltage by PCA 56 which is coupled to the target 56 via electrically biased sensing conductor 54. Processor 26 may then receive the digital signal from PCA 56 via conductor 58 for processing to determine if a nozzle or group of nozzles are working properly. Despite ink aerosol which may be present, target loop 76 does not substantially come into contact with the ink droplets 68, so it should not need to be cleaned. A spittoon 78 may be provided below the target loop 76 to collect the ink droplets 68 which are fired through the target loop 76. The spittoon 78 may be appropriately sized to have capacity to hold enough ink droplets 68 for the intended life of the printing mechanism which employs the target loop 76. The ink droplets 68 may form stalagmites, but the surface of the spittoon where the ink droplets 68 impact can be designed to be far enough away from the printhead 44 to avoid most concerns for stalagmite crashes with the printhead 44. If stalagmites are still a concern, an absorbent pad 80, made from such materials as foam or felt, may be fitted into the bottom of spittoon 78 and optionally pretreated with a solvent such as glycerol or polyethylene glycol (PEG). The solvent tends to dissolve the ink droplets 68, and the absorbent pad 80 tends to absorb the dissolved ink, thereby decreasing the likelihood of stalagmites.

Figure 11:
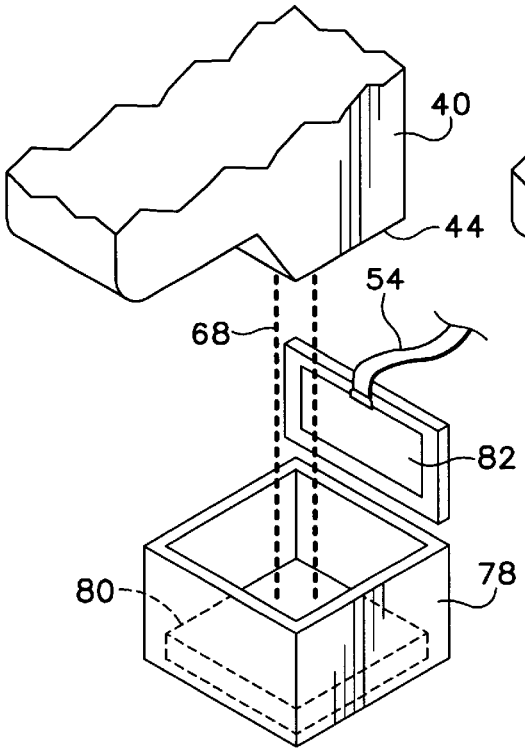
Figure 12:
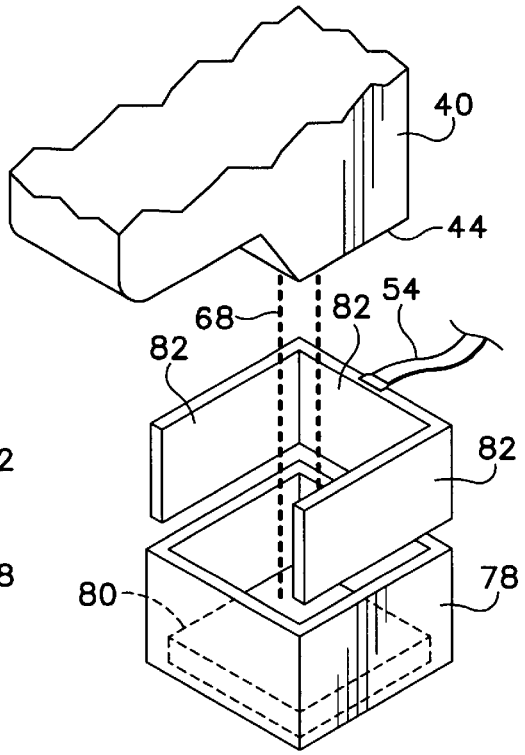
Figure 13:
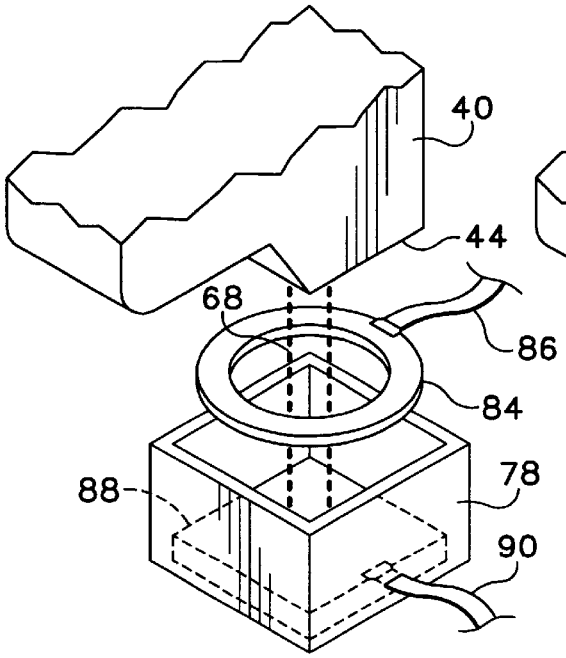
FIGS. 13–20 are enlarged, partially fragmented perspective views illustrating separate embodiments of non-contact charger drop detectors.
Figure 14:
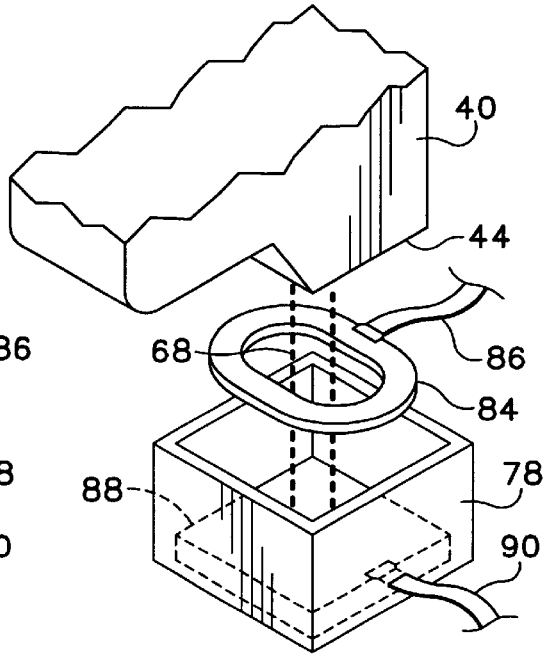
Figure 15:
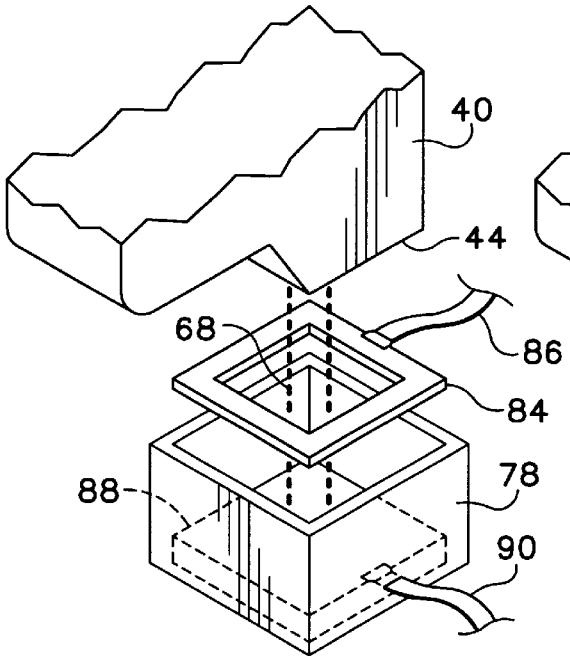
Figure 16:
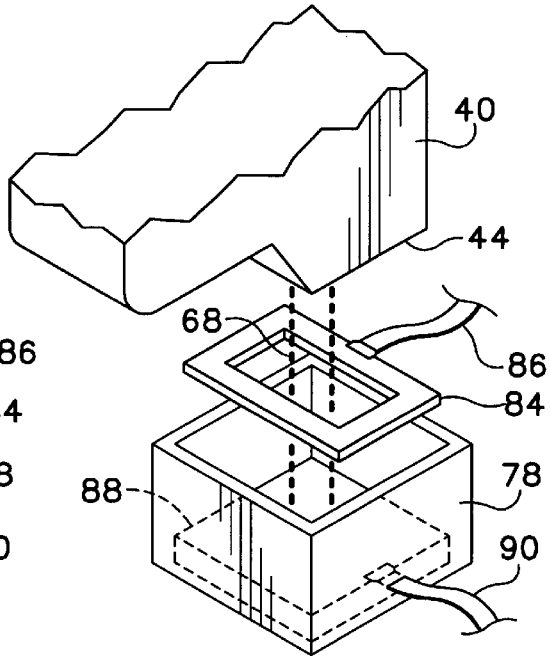
Figure 17:
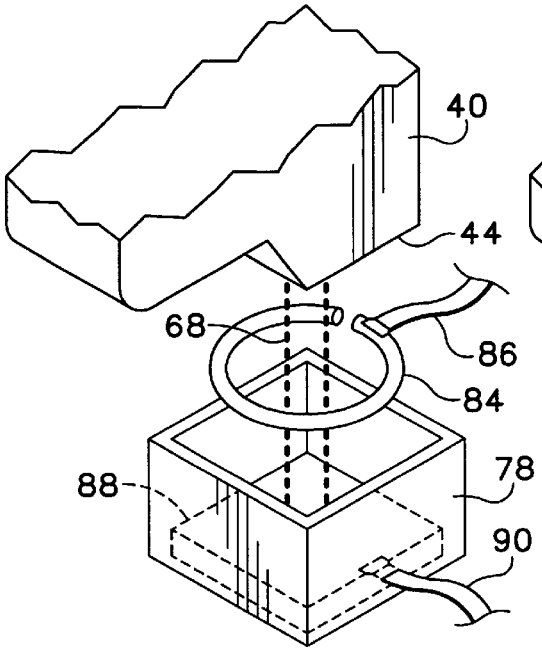
Figure 18:
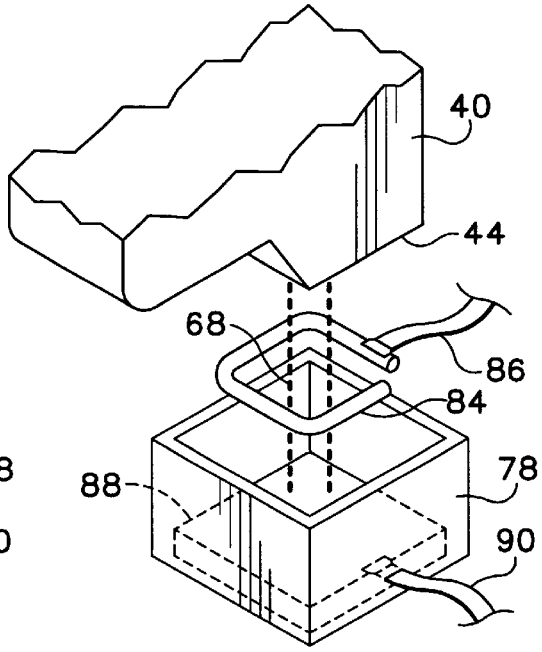

FIGS. 11–12 illustrate embodiments of a non-contact electrically biased sensing plate 82 for use with a drop detector system. In each of the embodiments illustrated in FIGS. 11–12, a pen, such as black pen 40, may be positioned such that the printhead 44 nozzles may be energized causing ink droplets 68 to pass through an electric field created between the electrically biased sensing plate 82 and the ground plane defined by the printhead 44 nozzles. As FIG. 12 illustrates, multiple electrically biased sensing plates 82 may be used. It is intended that electrically biased sensing plates not be limited to the configurations shown in FIGS. 11–12. Rather, the intent of illustrating possible designs for the electrically biased sensing plates 82 is to show that many plate orientations may be good candidates to select for a given application. The electrically biased sensing plates 82 may be constructed from metal, from conductive plastic, by coating a plastic of the desired shape with a conductive material, or by using a printed circuit board. Other methods of construction will be readily apparent to those skilled in the art, and are intended to be covered within the scope of this embodiment.

An electrically biased sensing conductor 54 may connect the non-contact electrically biased sensing plates 82 to the drop detector PCA 56 as illustrated in FIG. 1 for signal filtering and amplification. Electrically biased sensing conductor 54 provides a biasing voltage to the electrically biased sensing plates 82. The voltage present on the electrically biased sensing plates 82 creates an electric field between the sensing plates 82 and the ground plane present at the nozzle plate of the printhead 44. Selected printhead 44 nozzles may then be fired in response to commands from controller 26 to eject ink droplets 68 through the electric field. As each droplet 68 begins to exit the printhead 44 nozzle, a charge accumulates on the protruding tip of the drop, due to the influence of the printhead 44 nozzle plate-to-electrically biased sensing plates 82 electric field. When drop breakoff occurs, the droplet 68 retains this charge. As the droplet 68 approaches and passes by the electrically biased sensing plates 82, a small current is induced from the sensing plates 82, in relation to the charge on the ink droplet 68, to ground. The periodic flow of this induced current from ink droplets 68 passing by the sensing plates 82 may be converted to a digitized signal voltage by PCA 56 which is coupled to the target 56 via electrically biased sensing conductor 54. Processor 26 may then receive the digital signal from PCA 56 via conductor 58 for processing to determine if a nozzle or group of nozzles are working properly. Despite ink aerosol which may be present, electrically biased sensing plate 82 does not substantially come into contact with the ink droplets 68, so it should not need to be cleaned. A spittoon 78 may be provided below the sensing plates 82, inline with the droplets spit from printhead 44, to collect the ink droplets 68 which are fired past the sensing plate 82. The spittoon 78 may be appropriately sized to have capacity to hold enough ink droplets 68 for the intended life of the printing mechanism which employs the biased sensing plate 82. The ink droplets 68 may form stalagmites, but the surface of the spittoon where the ink droplets 68 impact can be designed to be far enough away from the printhead 44 to avoid most concerns for stalagmite crashes with the printhead 44. If stalagmites are still a concern, an absorbent pad 80, made from such materials as foam or felt, may fitted into the bottom of spittoon 78 and optionally pretreated with a solvent such as glycerol or polyethylene glycol (PEG). The solvent tends to dissolve the ink droplets 68, and the absorbent pad 80 tends to absorb the dissolved ink, thereby decreasing the likelihood of stalagmites.

FIGS. 13–18 illustrate embodiments of a non-contact electrically biased loop in conjunction with a contact sensing target for use with a drop detector system. In each of the embodiments illustrated in FIGS. 13–18, a pen, such as black pen 40, may be positioned such that the printhead 44 nozzles are aligned over the opening defined by the electrically biased loop 84. It is intended that electrically biased loop 84 not be limited to the sizes and shapes shown in FIGS. 13–18. Rather, the intent of illustrating various possible designs for the electrically biased loop 76 is to show that many shapes may be good candidates to select for a given application, such as, for example, circles, ovals, squares, rectangles, triangles, trapezoids, and other multi-sided or curved shapes. The electrically biased loop 84 may be constructed by stamping it from a sheet of metal, forming it out of a conductive plastic, coating a plastic of the desired shape with a conductive material, bending a wire, or using a printed circuit board. Other methods of construction will be readily apparent to those skilled in the art, and are intended to be covered within the scope of this embodiment.

Electrically biased conductor 86 provides a biasing voltage to the electrically biased loop 84. The voltage present on the electrically biased loop 84 creates an electric field between the electrically biased loop 84 and the ground plane present at the nozzle plate of the printhead 44. Selected printhead 44 nozzles may then be fired in response to commands from controller 26 to eject ink droplets 68 through the opening defined by electrically biased loop 84. As each droplet 68 begins to exit the printhead 44 nozzle, a charge accumulates on the protruding tip of the drop, due to the influence of the printhead 44 nozzle-plate-to-electrically biased loop 84 electric field. When drop breakoff occurs, the droplet 68 retains this charge. Droplet 68 passes through the opening defined by the electrically biased loop 84 and contacts conductive target 88. A sensing conductor 90 connects the target 88 to the drop detector PCA 56 as illustrated in FIG. 1 for signal filtering and amplification. When the droplet 68 contacts the conductive target 88, a small current is created from the target 88, in relation to the charge on the ink droplet 68, to ground. The periodic flow of the current from ink droplets 68 contacting the target 88 may be converted to a digitized signal voltage by PCA 56. Processor 26 may then receive the digital signal from PCA 56 via conductor 58 for processing to determine if a nozzle or group of nozzles are working properly. Despite ink aerosol which may be present, electrically biased loop 84 does not substantially come into contact with the ink droplets 68, so it should not need to be cleaned. The target 88 may be placed relatively far from the printhead 44 when compared to the electrically biased loop 84, reducing the likelihood that stalagmites from the ink droplets 68 may be a problem for the printhead 44. A spittoon 78 may be provided around target 88 to contain the ink residue incident on the target 88. Additionally, the conductive target 88 may be constructed of an absorbent pad which is pretreated with a conductive solvent such as glycerol or polyethylene glycol (PEG). Other absorbent materials may similarly be selected depending on design or cost restraints, for example, the conductive target 88 could be constructed of polyurethane or a rigid and porous sintered plastic. The solvent tends to dissolve the ink droplets 68. The absorbent pad version of conductive target 88 tends to absorb the dissolved ink, thereby decreasing the likelihood of stalagmites.

Figure 19:
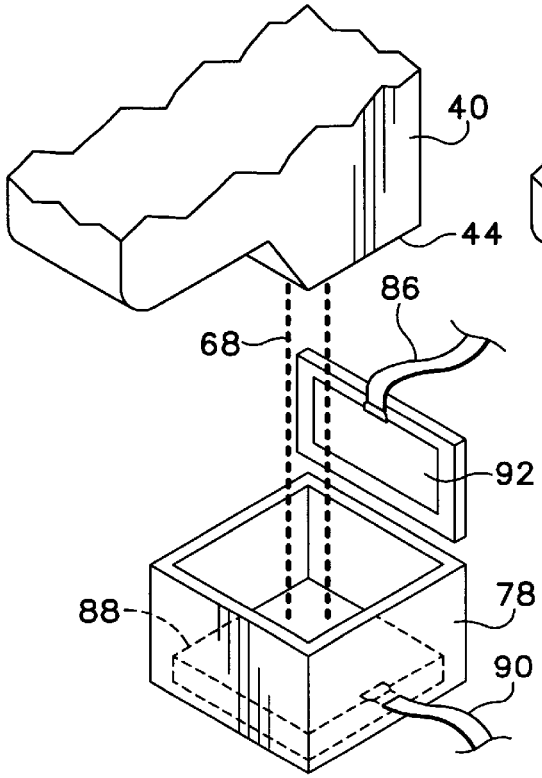
Figure 20:
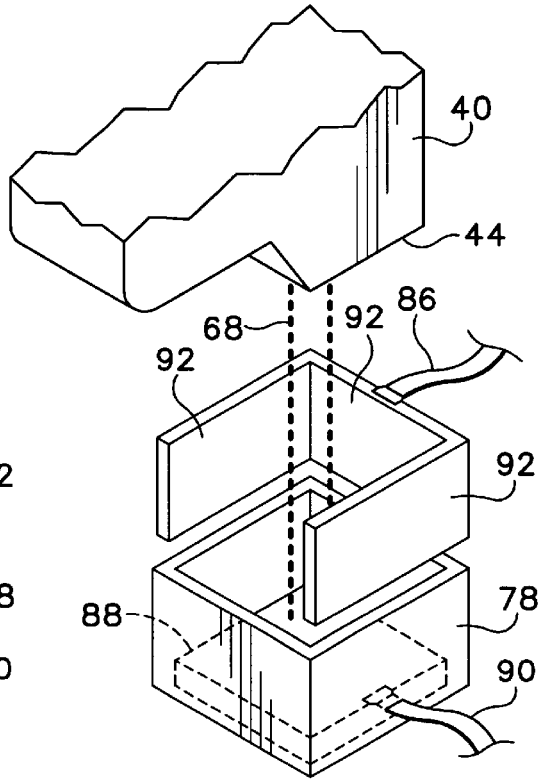

FIGS. 19–20 illustrate embodiments of a non-contact electrically biased plate 92 in conjunction with a contact sensing target 88 for use with a drop detector system. In each of the embodiments illustrated in FIGS. 19–20, a pen, such as black pen 40, may be positioned such that the printhead 44 nozzles may be energized causing ink droplets 68 to pass through an electric field created between the electrically biased plate 92 and the ground plane defined by the printhead 44 nozzles. As FIG. 20 illustrates, multiple electrically biased plates 92 may be used. It is intended that electrically biased plates 92 not be limited to the configurations shown in FIGS. 19–20. Rather, the intent of illustrating possible designs for the electrically biased plates 92 is to show that many plate orientations may be good candidates to select for a given application. The electrically biased plates 92 may be constructed from metal, molded of a conductive plastic, coated on a plastic of the desired shape with a conductive material, or fabricated by using a printed circuit board. Other methods of construction will be readily apparent to those skilled in the art, and are intended to be covered within the scope of this embodiment.

Electrically biased conductor 86 provides a biasing voltage to the electrically biased plates 92. The voltage present on the electrically biased plates 92 creates an electric field between the electrically biased plates 92 and the ground plane present at the nozzle plate of the printhead 44. Selected printhead 44 nozzles may then be fired in response to commands from controller 26 to eject ink droplets 68 through the electric field. As each droplet 68 begins to exit the printhead 44 nozzle, a charge accumulates on the protruding tip of the drop, due to the influence of the printhead 44 nozzle-plate-to-electrically biased plates 92 electric field. When drop breakoff occurs, the droplet 68 retains this charge. A sensing conductor 90 connects the target 88 to the drop detector PCA 56 as illustrated in FIG. 1 for signal filtering and amplification. When the droplet 68 contacts the conductive target 88, a small current is created from the target 88, in relation to the charge on the ink droplet 68, to ground. The periodic flow of the current from ink droplets 68 contacting the target 88 may be converted to a digitized signal voltage by PCA 56. Processor 26 may then receive the digital signal from PCA 56 via conductor 58 for processing to determine if a nozzle or group of nozzles are working properly. Despite ink aerosol which may be present, electrically biased plates 92 do not substantially come into contact with the ink droplets 68, so the plates 92 should not need to be cleaned. The target 88 may be placed relatively far from the printhead 44 when compared to the electrically biased plates 92, reducing the likelihood that possible stalagmites from the ink droplets 68 may be a problem for the printhead 44. A spittoon 78 may be provided around target 88 to contain the ink residue incident on the target 88. Additionally, the conductive target 88 may be constructed of an absorbent pad which is pretreated with a conductive solvent such as glycerol or polyethylene glycol (PEG). Other absorbent materials may similarly be selected depending on design or cost restraints, for example, the conductive target 88 could be constructed of polyurethane or a rigid and porous sintered plastic. The solvent tends to dissolve the ink droplets 68. The absorbent pad version of conductive target 88 tends to absorb the dissolved ink, thereby decreasing the likelihood of stalagmites.

In each of the embodiments illustrated in FIGS. 13–20, the non-contact loops 84 and the non-contact plates 92 have been described as supplied with a biasing voltage by conductor 86. Additionally, the targets 88 in FIGS. 13–20 have been described as connected to the drop detector PCA 56 by conductor 90. It is also possible, however, to switch the connectors 86 and 90 so that the loops 84 and plates 92 are used exclusively as non-contact sensing elements for ink drop detection and the targets 88 are used exclusively for electrically biasing. In this set of embodiments, As each droplet 68 begins to exit the printhead 44 nozzle, a charge accumulates on the protruding tip of the drop, due to the influence of the printhead 44 nozzle-plate-to-target 88 electric field. When drop breakoff occurs, the droplet 68 retains this charge. When the droplet 68 passes by the loop 84 or plates 92, a small current is induced from the loop 84 or the plates 92, in relation to the charge on the ink droplet 68, to ground. The periodic flow of this induced current may be converted to a digitized signal voltage by PCA 56. Processor 26 may then receive the digital signal from PCA 56 via conductor 58 for processing to determine if a nozzle or group of nozzles are working properly.

Various non-contact electrically biasing and sensing electrostatic drop detect target configurations, as well as absorbent target configurations have been illustrated with example embodiments to enable a low cost and efficient method and mechanism for ink drop detection which is less susceptible to waste ink residue build-up. Each of the target and electrically biasing element embodiments illustrated in FIGS. 1–20 may be constructed in varying sizes to accommodate a portion of a printhead's 44, 46 nozzles, an entire printhead's 44, 46 nozzles, or even all of the nozzles for multiple printheads 44, 46. Additionally, target and electrically biasing element embodiments illustrated in FIG. 1 and FIGS. 5–20 may be located in many locations below the plane defined by printheads 44, 46. Examples of locations for the target and electrically biasing element embodiments illustrated in FIG. 1 and FIGS. 5–20 include, for example, the "inboard region" 52 between the printzone and the service station, the "outboard region" 60 which is on the opposite side of printzone 30 from the service station 48, the servicing region 38, and "outside service station region" 62.

Non-contact electrically biasing and sensing electrostatic drop detect target configurations, as well as absorbent target configurations enable a printing mechanism to reliably and economically gather ink drop detection readings, without the need for a cleaning mechanism to clean the target surface, in order to provide users with consistent, high-quality, and economical inkjet output despite printheads 44, 46 which may clog over time. In discussing various components of the non-contact electrically biasing and sensing electrostatic drop detect target configurations, as well as absorbent target configurations, various benefits have been noted above.

It is apparent that a variety of other structurally equivalent modifications and substitutions may be made to construct non-contact electrically biasing and sensing electrostatic drop detect target configurations, as well as absorbent target configurations, according to the concepts covered herein depending upon the particular implementation, while still falling within the scope of the claims below.

We claim:

1. A sensor configuration for use in detecting ink droplets ejected from an ink drop generator, comprising:

a sensing element configured to receive a biasing voltage which creates an electric field from the sensing element to the ink drop generator; and a sensing amplifier coupled to the sensing element, whereby the sensing element is imparted with an electrical stimulus when at least one ink droplet is ejected in the presence of the electric field, and thereafter passes in close proximity to the sensing element without substantially contacting the sensing element.

2. A sensor configuration according to claim 1, wherein the sensing element comprises a conductive target loop.

3. A sensor configuration according to claim 2 further comprising a spittoon receptacle for receiving ink droplets ejected from the ink drop generator after the ink droplets pass in close proximity to the target loop.

4. A sensor configuration according to claim 3 further comprising an absorbent material supported inside the spittoon receptacle.

5. A sensor configuration according to claim 4 further comprising an ink solvent impregnated into the absorbent material.

6. A sensor configuration according to claim 2 further comprising an absorbent material for receiving ink droplets ejected from the ink drop generator after the ink droplets pass in close proximity to the target loop.

7. A sensor configuration according to claim 6 further comprising an ink solvent impregnated into the absorbent material.

8. A sensor configuration according to claim 1, wherein the sensing element comprises at least one conductive wall.

9. A sensor configuration according to claim 8 further comprising a spittoon receptacle for receiving ink droplets ejected from the ink drop generator after the ink droplets pass in close proximity to the conductive wall.

10. A sensor configuration according to claim 9 further comprising an absorbent material supported inside the spittoon receptacle.

11. A sensor configuration according to claim 10 further comprising an ink solvent impregnated into the absorbent material.

12. A sensor configuration according to claim 8 further comprising an absorbent material for receiving ink droplets ejected from the ink drop generator after the ink droplets pass in close proximity to the conductive wall.

13. A sensor configuration according to claim 12 further comprising an ink solvent impregnated into the absorbent material.

14. A printing mechanism, comprising:

a printhead having ink drop generators for selectively ejecting ink; and an ink drop sensor for detecting ink droplets ejected from the ink drop generators, comprising:

a sensing element configured to receive a biasing voltage which creates an electric field from the sensing element to the ink drop generator; and a sensing amplifier coupled to the sensing element, whereby the sensing element is imparted with an electrical stimulus when at least one ink droplet is ejected in the presence of the electric field, and thereafter passes in close proximity to the sensing element without substantially contacting the sensing element.

15. A printing mechanism according to claim 14 further comprising a spittoon receptacle for receiving ink droplets ejected from the ink drop generator after the ink droplets pass in close proximity to the sensing element.

16. A printing mechanism according to claim 15 further comprising an absorbent material supported inside the spittoon receptacle.

17. A printing mechanism according to claim 16 further comprising an ink solvent impregnated into the absorbent material.

18. A printing mechanism according to claim 14 further comprising an absorbent material for receiving ink droplets ejected from the ink drop generator after the ink droplets pass in close proximity to the sensing element.

19. A printing mechanism according to claim 18 further comprising an ink solvent impregnated into the absorbent material.

20. A printing mechanism according to claim 14, further comprising:

a frame;

a base, coupled to the frame, for supporting print media in a printzone; and wherein the sensing element is integral with the base.

21. A printing mechanism according to claim 20, wherein the printhead comprises a full-width printhead which has ink drop generators aligned over at least the entire printzone.

22. A printing mechanism according to claim 21, wherein the sensing element integral with the base extends for a width at least the entire printzone.

23. A method of making ink drop detection measurements in a printing mechanism, comprising:

positioning a print media in a printzone;

positioning an ink printhead over the print media in the printzone;

ejecting at least one ink droplet from the printhead onto the print media;

applying an electrical charge to the ink droplet before the droplet contacts the print media; and sensing a capacitively induced current in a sensor located below the print media in the printzone when the ink droplet contacts the print media on the side of the media opposite the sensor.

24. A method of making drop detection measurements in a printing mechanism according to claim 23, further comprising performing the actions of claim 23 repeatedly as part of an action to print a printhead calibration and test page.

25. A method of making drop detection measurements according to claim 24, further comprising processing the sensed current to determine a characteristic of the ink drops.

26. A method of making drop detection measurements according to claim 25, wherein the characteristic is whether the printhead is ejecting drops.

27. A method of making drop detection measurements according to claim 25, wherein the characteristic is the volume of ejected ink drops.

28. A method of making drop detection measurements according to claim 25, wherein the characteristic is the velocity of the ejected ink drops.

29. A method of making drop detection measurements in a printing mechanism according to claim 23, further comprising performing the actions of claim 23 repeatedly as part of a print job.

30. A method of making drop detection measurements according to claim 29, further comprising processing the sensed current to determine a characteristic of the ink drops.

31. A method of making drop detection measurements according to claim 30, wherein the characteristic is whether the printhead is ejecting drops.

32. A method of making drop detection measurements according to claim 30, wherein the characteristic is the volume of ejected ink drops.

33. A method of making drop detection measurements according to claim 30, wherein the characteristic is the velocity of the ejected ink drops.

* * * * *